US005086733A

United States Patent [19]

Inoue et al.

[11] Patent Number: 5,086,733

[45] Date of Patent: Feb. 11, 1992

[54] COOLING SYSTEM FOR MULTI-CYLINDER ENGINE

[75] Inventors: Kazuo Inoue; Noriyuki Kishi; Hiroo Shimada; Masakatsu Miyao; Katsunori Nakamura; Tsuneo Konno; Harumi Taketomi, all of Saitama, Japan

[73] Assignee: Honda Giken Kogyo Kabushiki Kaisha, Tokyo, Japan

[21] Appl. No.: 398,006

[22] Filed: Aug. 23, 1989

[30] Foreign Application Priority Data

| | | | |
|---|---|---|---|
| Aug. 23, 1988 | [JP] | Japan | 63-209279 |
| Sep. 20, 1988 | [JP] | Japan | 63-235486 |
| Nov. 1, 1988 | [JP] | Japan | 63-277097 |

[51] Int. Cl.[5] ..... F02F 1/10

[52] U.S. Cl. ..... 123/41.84; 123/41.79

[58] Field of Search ..... 123/41.72, 41.74, 41.79, 123/41.81, 41.83, 41.84, 41.82 R, 195 R, 195 S

[56] References Cited

U.S. PATENT DOCUMENTS

| | | | |
|---|---|---|---|
| 1,575,638 | 3/1926 | Pochobradsky et al. | 123/41.84 |
| 3,800,751 | 4/1974 | Glassey et al. | 123/41.84 |
| 3,991,735 | 11/1976 | Horstmann | 123/195 R |

FOREIGN PATENT DOCUMENTS

| | | | |
|---|---|---|---|
| 0196635 | 3/1986 | European Pat. Off. . | |
| 0232467 | 10/1986 | European Pat. Off. . | |
| 1751787 | 2/1972 | Fed. Rep. of Germany . | |
| 553461 | 5/1923 | France . | |
| 609917 | 8/1926 | France | 123/41.84 |
| 2155545 | 3/1985 | United Kingdom . | |

*Primary Examiner*—Noah P. Kamen
*Attorney, Agent, or Firm*—Lyon & Lyon

[57] ABSTRACT

In a cooling system for a multi-cylinder engine, a main gallery is provided around outer peripheral portions of the plurality of cylinder bores upstream a block-side coolant jacket to commonly surround the cylinder bores, and an upstream coolant gallery is provided between the block-side coolant jacket and the main coolant gallery to separately surround each of outer peripheries of the cylinder bores. The upstream coolant gallery and the main coolant gallery is in communication with each other through a constriction communication passage provided around the outer periphery of each of the cylinder bores, and the upstream coolant gallery is further in communication with an upstream end of the block-side coolant jacket. The cooling system further includes a block-side and flange-surrounding coolant gallery provided in the cylinder block to surround an outer periphery of the outward flange of a cylinder liner, and a plurality of dispensing passages permitting the communication between said block-side coolant jacket and said flange-surrounding coolant gallery. Further, a jacket sidewall is disposed in the cylinder head inside at least one of opposite outside walls in an axial direction of a crank shaft to define a head-side coolant jacket.

21 Claims, 21 Drawing Sheets

COOLING SYSTEM FOR MULTI-CYLINDER ENGINE

BACKGROUND OF THE INVENTION

1. Field of the Invention

The field of the present invention is cooling systems using a coolant for multi-cylinder engines.

2. Description of the Prior Art

Conventional cooling systems typically have a common coolant jacket around a plurality of cylinder bores in a cylinder block of a multi-cylinder engine. Cooling water flows through the coolant jacket to cool the periphery of the cylinder bores.

In these known cooling systems, however, certain problems are encountered. The cylinder bores are surrounded, over a region from their upper portions to their lower portions, by a common coolant jacket. Hence, a cylinder located away from a coolant inlet may be cooled by coolant which has already been warmed by another cylinder located near the inlet. Thus, the cylinders tend to be cooled unevenly. In addition, due to a variation and unevenness in the flow area of the coolant passages, not only may the flow resistance of the coolant passages be increased, but also the coolant may be apt to stagnate at certain locations. Consequently, the total cooling efficiency suffers.

In addition, certain systems involve a cylinder liner having an outward flange at its upper end, inserted into the cylinders. With these systems, it is difficult to uniformly and efficiently cool the flange portion of the cylinder liner, which is heated to a relatively high temperature. Particularly, in a cooling system in which the spacing between cylinders is reduced in order to make the engine compact, adjoining portions of the flanges of the adjacent cylinder liners are chamfered and placed in contact with each other. Then, in the prior art, it has been impossible to directly cool such contacting portions of the flanges.

Another multi-cylinder engine has an engine block including a cylinder block having a block-side coolant jacket surrounding cylinder bores and a cylinder head having a head-side coolant jacket coupled to the block. The head-side coolant jacket surrounds the combustion chambers defined above the pistons and communicates with the block-side coolant jacket. Opposite outside walls of the cylinder head extend parallel to the crank shaft and are substantially aligned with opposite outside walls of the cylinder block (for example, see Japanese Patent Application Laid-open No.81451/85). In such multi-cylinder engines, the head-side coolant jacket is provided over substantially the entire surface of the cylinder head. In some cases, the cylinder block may have an outside wall spaced outwardly from the block-side coolant jacket, in order to improve the rigidity and strength of the cylinder block. In such cases, if the head-side coolant jacket is provided over substantially the entire surface of the cylinder head as described above, coolant flows over a wide area, including portions other than the combustion chamber area of the cylinder head, where the highest temperatures occur. Consequently, the flow speed of the coolant within the head-side coolant jacket is reduced, resulting in a decreased cooling efficiency in the cylinder head.

SUMMARY OF THE INVENTION

Accordingly, it is an object of the invention to provide a cooling system for a multi-cylinder engine, which has a substantially uniform flow of coolant with an increased cooling area and coolant flow speed, thereby substantially improving the total cooling efficiency.

It is another object of the present invention to provide such a cooling system in which coolant uniformly flows directly along an outer periphery of an outward flange of each cylinder liner.

It is a further object of the present invention to provide a cooling system which prevents reduction of the coolant flow speed in a head-side coolant jacket.

To these ends, a cooling system for a multi-cylinder engine has a block-side coolant jacket around outer peripheral portions of a plurality of cylinder bores, so that coolant flows through the block-side coolant jacket, thereby cooling the cylinder block. A continuous channel is provided around outer peripheral portions of the cylinder bores to commonly surround the cylinder bores. An upstream coolant channel between the block-side coolant jacket and the main coolant channel separately surrounds each of outer peripheries of the cylinder bores. The upstream coolant channel and the main coolant channel are connected to each other through a constriction communication or orifice passage around the outer periphery of each of the cylinder bores. The upstream coolant channel is also connected with an upstream end of the block-side coolant jacket. Coolant is uniformly distributed at an increased flow speed to the block-side coolant jacket thereby efficiently cooling the heated portions of the cylinder block.

In a second feature of the present invention, a cooling system for a multi-cylinder engine has a block-side coolant jacket around outer peripheral portions of a plurality of cylinder bores. The block-side coolant jacket includes a plurality of coolant passages independently defined around each of the cylinder bores. A main coolant channel is provided around outer peripheral portions of the cylinder bores. An upstream coolant channel between the block-side coolant jacket and the main coolant channel separately surrounds an outer periphery of each of the cylinder bores. Coolant is rapidly and uniformly distributed at an increased flow speed without resistance to the block-side coolant jacket and the cooling surface area of the block-side coolant jacket is increased. This efficiently cools the heated portions of the cylinder block.

In a third embodiment, a block-side coolant jacket in the cylinder block surrounds an outer periphery of each of the cylinder liners. A block-side flange-surrounding coolant channel provided in the cylinder block surrounds an outer periphery of the outward flange of the cylinder liner, and a plurality of dispensing passages permit the communication between the block-side coolant jacket and the flange-surrounding coolant channel. The outward flanges of the cylinder liners are uniformly and efficiently cooled.

In a fourth embodiment, a cylinder head has a head-side coolant jacket which surrounds combustion chambers defined above the pistons in the cylinder bores. The head-side coolant jacket leads to the block-side coolant jacket. The head-side coolant jacket is provided only in a relatively narrow section required to be cooled. Hence, the coolant flow speed can be raised in the head-side coolant jacket, thereby improving the cooling efficiency for the cylinder head.

Other objects, features and advantages of the invention will become apparent from the following description of the preferred embodiments, taken in conjunction with the accompanying drawings.

BRIEF DESCRIPTION OF THE DRAWINGS

In the drawings, wherein similar reference numbers denote similar elements throughout the several views:

FIGS. 1 to 10 illustrate a first embodiment of the present invention, wherein FIG. 1 is a plan view of a cylinder block with cylinder liners inserted in cylinders;

FIG. 2 is a plan view thereof with the cylinder liners removed from the cylinders;

FIG. 3 is a section view fragment thereof, taken along a line III—III in FIG. 1;

FIG. 4 is a section view fragment thereof, taken along a line IV—IV in FIG. 3;

FIG. 5 is a section view fragment thereof, taken along a line V—V in FIG. 3;

FIG. 6 is a section view thereof, taken along a line VI—VI in FIG. 3;

FIG. 7 is a section view thereof, taken along a line VII—VII in FIG. 3

FIG. 8 is a perspective view of a portion of the cylinder block;

FIG. 9 is a bottom perspective view of a portion of the cylinder head, taken along a line IX—IX in FIG. 4; and FIG. 10 is a section view of the cylinder block and the cylinder head, taken along a line X—X in FIG. 4;

FIGS. 12 to 14 illustrate a second embodiment of the present invention, wherein FIG. 12 is a plan view of a portion of a cylinder block with cylinder liners inserted therein;

FIG. 13 is a section view fragment thereof, taken along a line XIII—XIII in FIG. 12; and FIG. 14 is a perspective view of a portion of the cylinder block thereof;

FIGS. 16 to 22 illustrate a fourth embodiment of the present invention, wherein FIG. 16 is a front view in part section of a multi-cylinder engine with the present cooling system;

FIG. 17 is a partial section view thereof, taken along a line XVII—XVII in FIG. 16;

FIG. 18 is a view fragment taken along a line XVIII—XVIII in FIG. 17;

FIG. 19 is a section view of a portion of the cylinder head, taken along a line XIX—XIX in FIG. 17;

FIG. 20 is a bottom view of a portion of the cylinder head, taken along a line XX—XX in FIG. 17;

FIG. 21 is a section view of a portion of the cylinder head, taken along a line XXI—XXI in FIG. 19; and FIG. 22 is a section view of a portion of the cylinder head, taken along a line XXII—XXII in FIG. 19.

DESCRIPTION OF THE PREFERRED EMBODIMENTS

Figure 3:
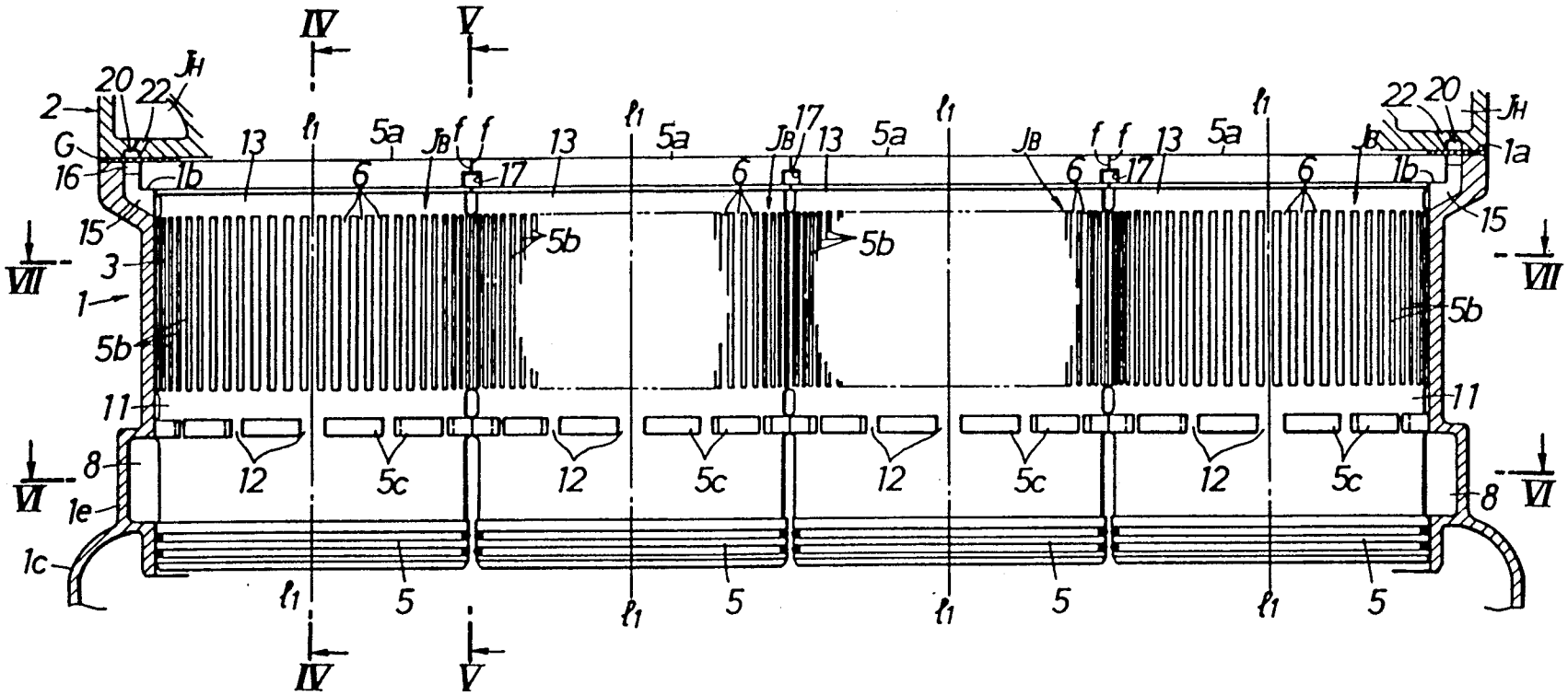
Figure 4:
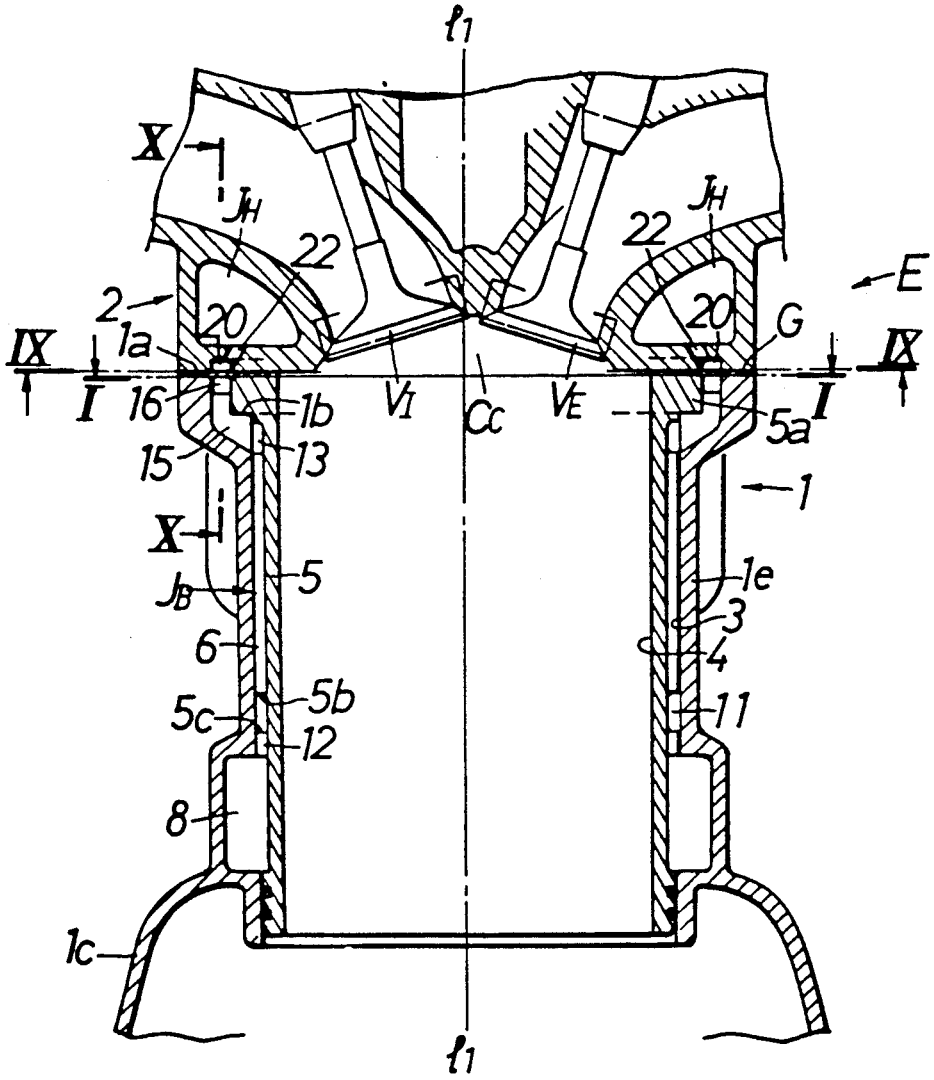

Turning now to the drawings, as shown in FIGS. 3 and 4, a body E of the engine comprises a cylinder block 1 and a cylinder head 2 joined to a deck surface la of the cylinder block 1 through a gasket G as in a conventional case.

A first embodiment of the cooling system of the present invention will be described below with reference to FIGS. 1 to 10.

Four cylinders 3 are arranged in series in the cylinder block 1. A wet liner 5 comprising a hollow cylindrical cylinder liner having an outward flange portion 5*a* formed at its upper end, is inserted into each cylinder 3. The wet liner 5 may be fitted into the cylinder block I by a press-fitting or the like, or integrally cast into the cylinder block 1. The outward flange portion 5*a* is supported in the cylinder block 1 by placement onto an annular bearing surface lb formed on an upper end of the cylinder block 1. A piston (not shown) is slidably received in a cylinder bore 4 in the wet liner 5.

Figure 7:
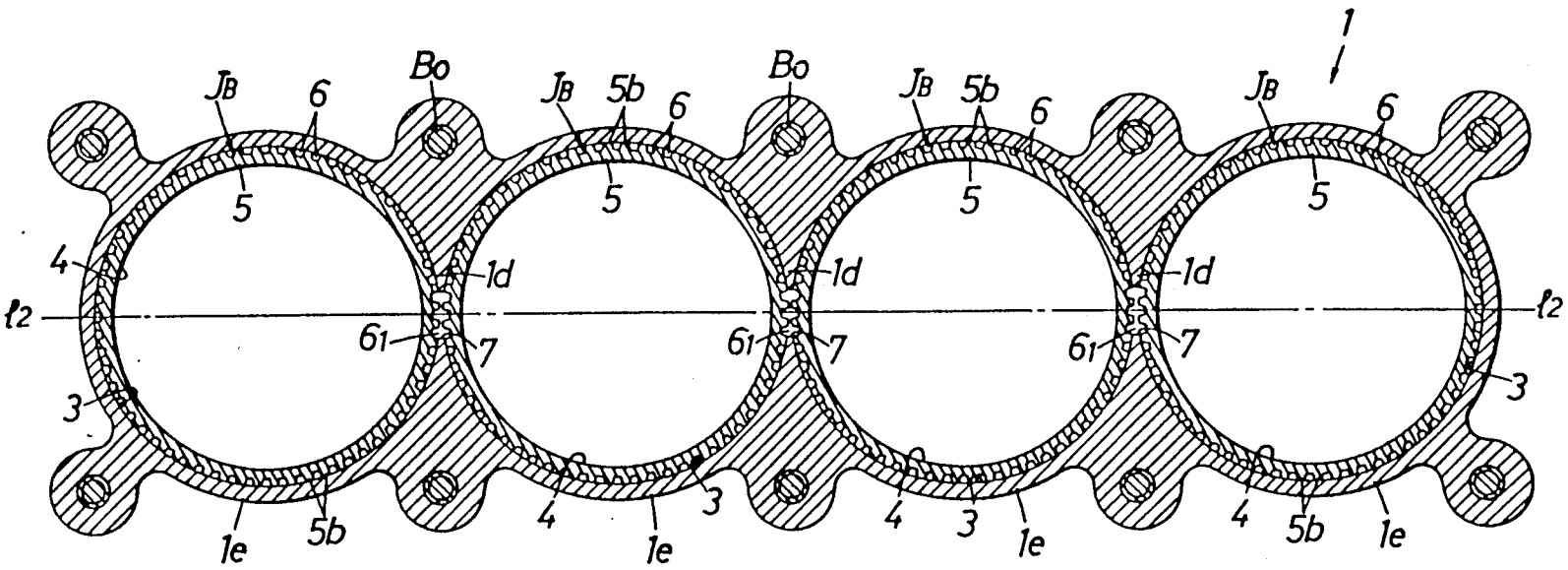
Figure 8:
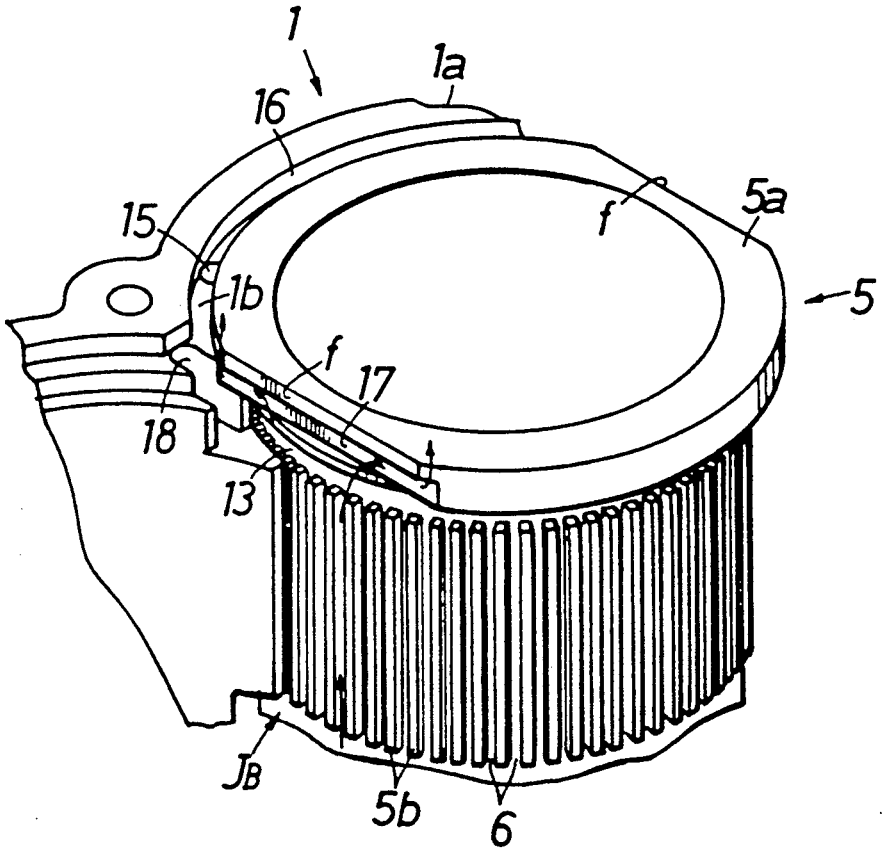

As shown in FIGS. 3, 7 and 8, a plurality of cooling fins 5*b* are circumferentially mounted on the entire outer peripheral surface of the wet liners 5 and extend parallel to each other in the direction of the cylinder axis $l_1$—$l_1$ as shown in FIG. 3. When the wet liner 5 has been fitted into the cylinder 3, the outer surfaces of the cooling fins 5*b* closely contact the inner peripheral surface of a cylinder wall 1*e* of the cylinder block 1. The cooling fins 5*b* and cylinder wall 1*e* define a plurality of rectilinear parallel cooling passages 6 extending in the direction of the cylinder axis $l_1$—$l_1$, between the individual adjacent cooling fins 5*b*, thereby forming a block-side cooling jacket $J_B$. In the coolant flow system, the lower side of the block-side cooling jacket $J_B$, i.e., a side of the cylinder block 1 closer to a crank case 1*c*, is the upstream side. The side of the cooling jacket $J_B$ closer to the deck surface 1*a*, on the other hand, is the downstream side.

Figure 2:
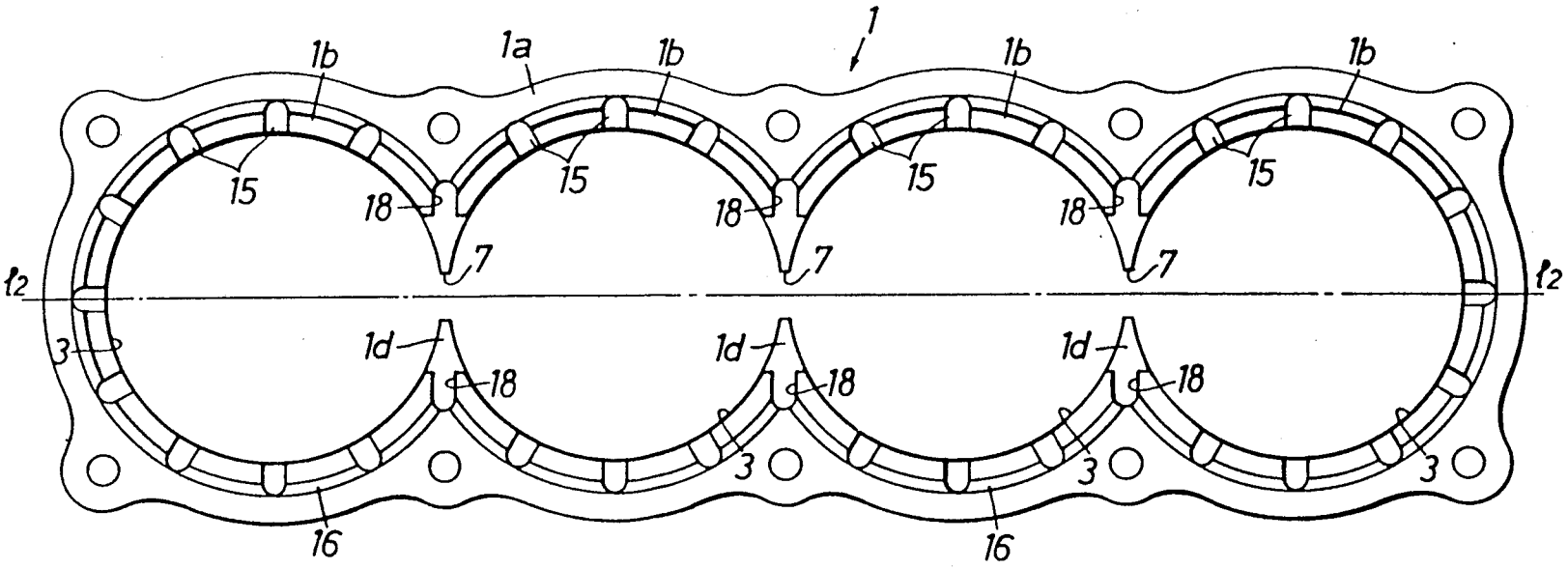

As shown in FIGS. 2 and 7, the block 1 includes a wall 1*d* between the adjacent wet liners 5. The wall 1*d* is cut away at a portion astride a crank axis $l_2$—$l_2$ to leave a space therebetween or a band-like notch 7 having a predetermined width. At the notch 7, the outer surfaces of the adjacent wet liners 5 are opposed to each other at a slight distance. Some cooling fins 5*b* on the opposed outer surfaces are aligned in phase with each other to define therebetween coolant passages 61 common to the adjacent cylinders 3 and having a large passage sectional area. Adjoining portions of the adjacent wet liners 5 will be heated to a highest temperature, but the common coolant passages $6_1$ in the adjoining portions have an increased cooling efficiency, because they have a large flow section area.

Figure 6:
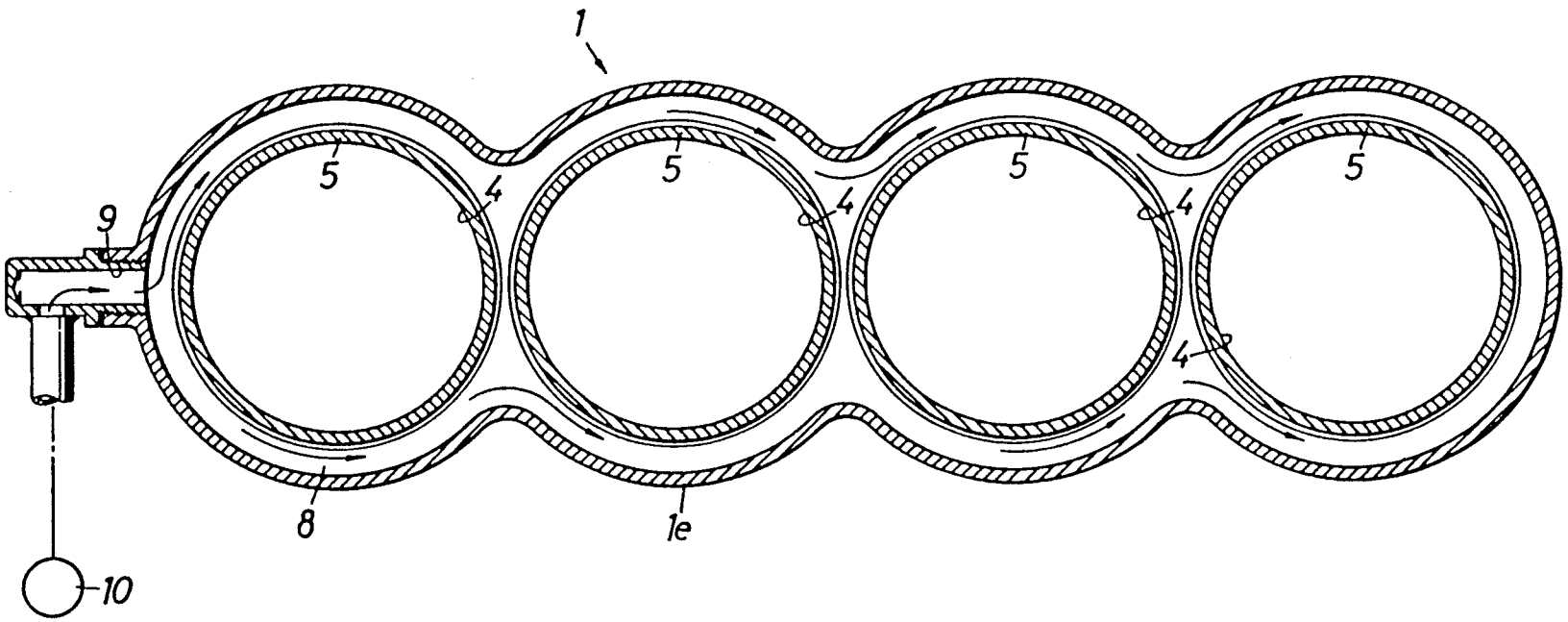

As shown in FIGS. 3, 4 and 6, a main coolant channel 8 having a relatively large capacity is defined between lower portions of the wet liners 5 and corresponding cylinder wall 1*e* of the cylinder block 1. The channel 8 commonly surrounds the outer surface of the wet liners 5. Referring to FIG. 6, an inlet port 9, at one end of channel 8, is connected to a pump 10 connected to a cooling circuit which is not shown.

As shown in FIG. 4, directly below the block-side coolant jacket $J_B$ comprising the plurality of coolant passages 6, an annular upstream coolant channel 11 is defined around the outer periphery of the individual wet liners 5. The outer surface of the wet liner 5 and an inner surface of the cylinder wall 1*e* of the cylinder block 1 define the channel 11. Upstream channel 11 is in direct communication with the lower end, i.e., the upstream end, of the block-side coolant jacket $J_B$.

As shown in FIG. 3, an annular partition wall 5*c* is integrally formed in a fillet-like configuration on the outside of each wet liner 5, to partition the main coolant channel 8 and the upstream coolant channel 11. The outer periphery of the partition wall 5c is in close contact with the inner surface of the cylinder wall 1e. A plurality of constriction communication passages or orifice passages 12 are defined in each of the partition walls 5c at circumferential intervals. The main coolant channel 8 is connected with the upstream coolant channel 11 through these orifice passages 12. Thus, coolant, such as water, flowing through the main coolant channel 8 passes through the plurality of orifice passages 12 into the upstream coolant channel 11, and then further flows into the block-side coolant jacket $J_B$.

Directly above the block side coolant jacket $J_B$, an annular downstream coolant channel 13 is defined around each of the wet liners 5 by the outer surface of each wet liner 5 and the inner surface of the cylinder wall le of the cylinder block 1. The channel 13 is in direct communication with the upper end, i.e., the downstream end of the block-side coolant jacket $J_B$.

Figure 1:
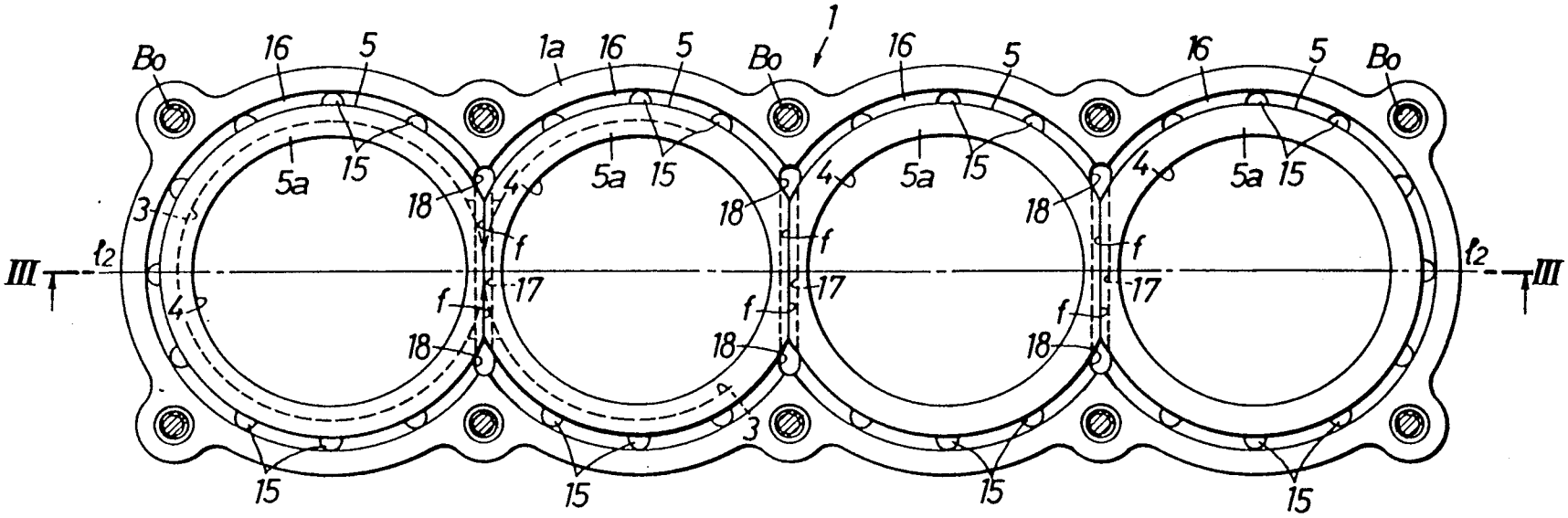
Figure 10:
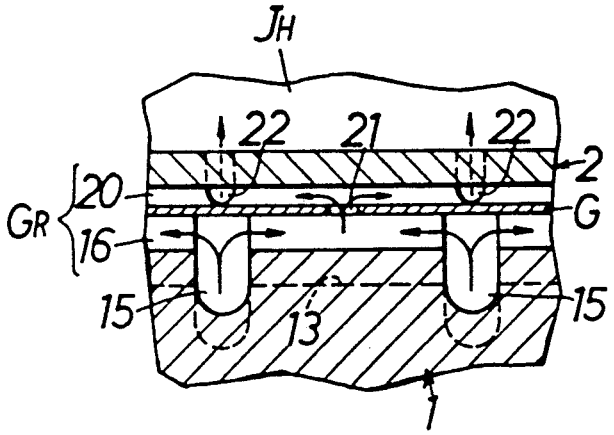

As shown in FIGS. 4 and 10, a plurality of U-shaped dispensing passages 15 are defined at circumferential distances at the upper end of the inner wall of each cylinder 3. Passages 15 are in direct communication or connection with the downstream coolant channel 13, and have top ends opened to the deck surface 1a of the cylinder block. As shown in FIG. 1, an endless block-side flange-surrounding coolant channel 16 is also defined between the outer surfaces of the outward flange portions 5a of the wet liners 5 and the upper ends of the inner surfaces of the cylinders 3, so as to commonly surround the outer surfaces of the outward flange portions 5a. The block-side flange-surrounding coolant channel 16 connects with the dispensing passages 15. Thus, the coolant entering the downstream coolant channel 13 flows into dispensing passages 15 and then into the block-side flange-surrounding coolant channel 16.

Figure 5:
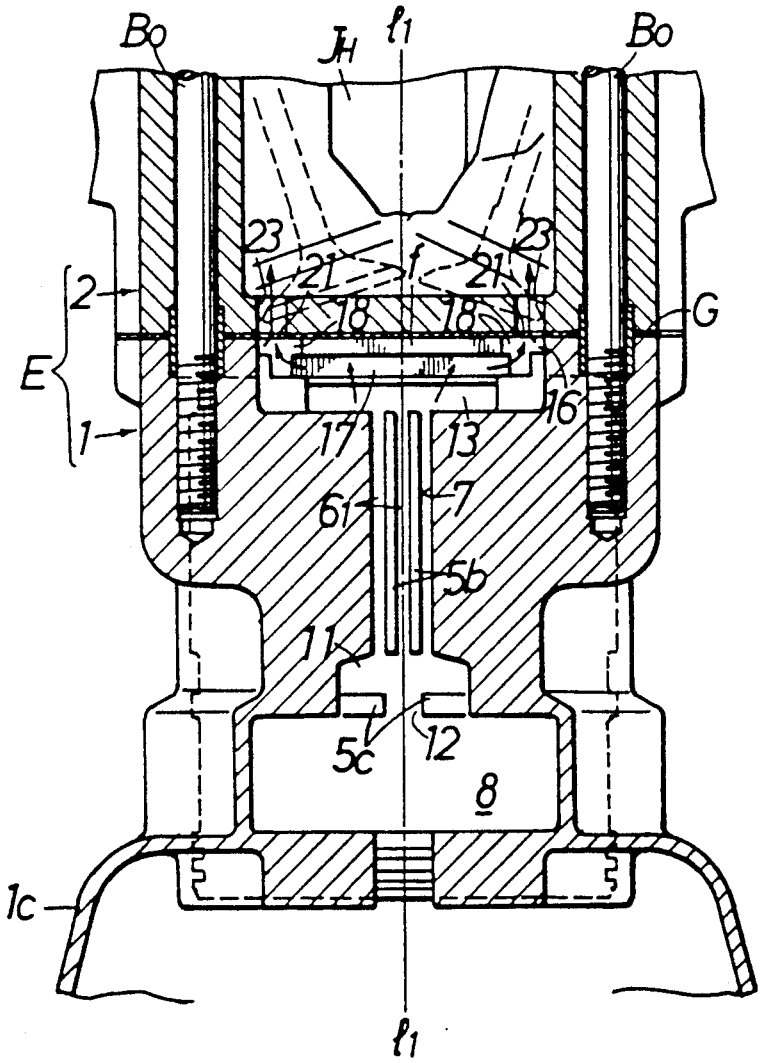

Referring to FIGS. 1 and 8, the adjoining portions of the outward flange portions 5a of the adjacent wet liners 5 are chamfered substantially flat at portions f and are in contact with each other. As shown in FIGS. 5 and 8, a rectilinear inter-flange coolant passage 17 is defined under the contacting chamfered portions. The opposite ends of passage 17 connect with the block-side flange-surrounding coolant channel 16. The lower surface of passage 17 is opened into the downstream coolant channel 13. Thus, the coolant within the downstream coolant channel 13 flows into the inter-flange coolant passage 17. From there, coolant flows out of opposite ends of passage 17 into the block-side flange-surrounding coolant channel 16, as shown in FIG. 8. Longitudinal passages 18 are provided at the opposite ends of the inter-flange coolant passage 17 to permit direct communication between the downstream coolant channel 13 and the block-side flange-surrounding coolant channel 16. As a result, so that part of the coolant within the downstream coolant channel 13 flows through the longitudinal passages 18 directly into a head-side coolant jacket $J_M$ described below.

Figure 9:
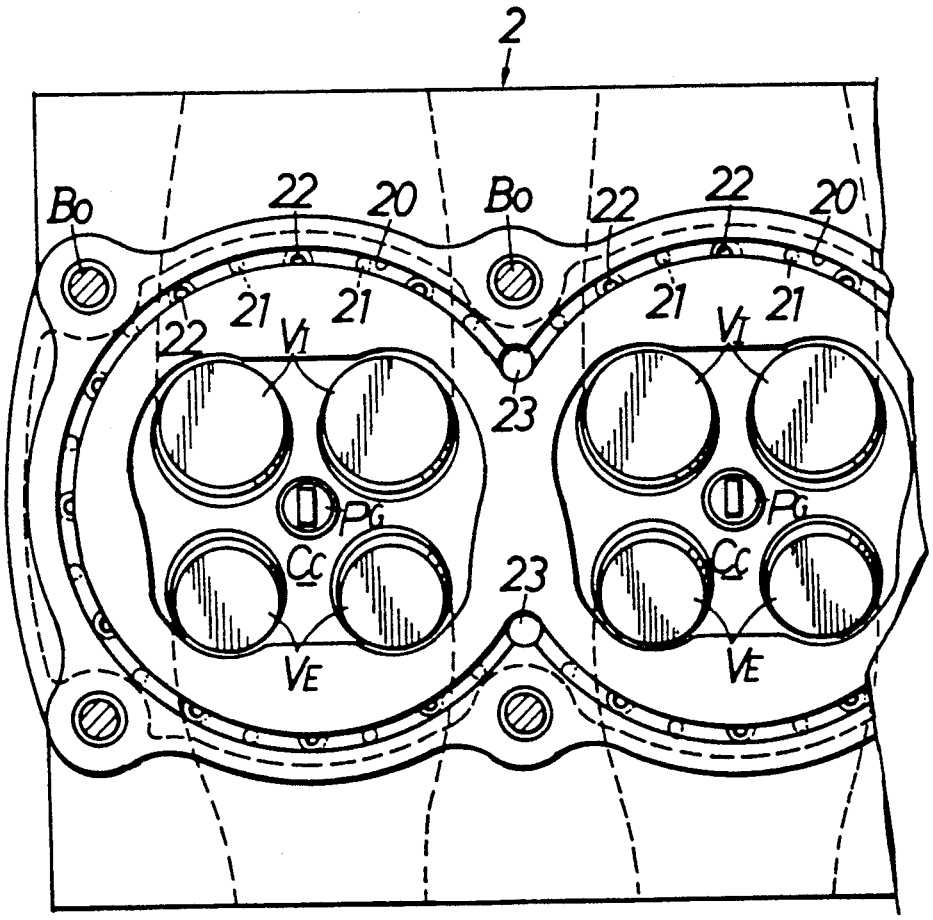

As shown in FIG. 9, a lower surface of the cylinder head 2 (joined to the deck surface la of the cylinder block 1 through the gasket G) has a head-side flange-surrounding coolant channel 20. Channel 20 has an inverted U-shaped cross-section opposed to the block-side flange-surrounding coolant channel 16 through the gasket G. The coolant channels 16 and 20 are connected to each other through a plurality of holes 21 in the gasket G, as shown in FIG. 10. The flange-surrounding coolant channels 16 and 20 cooperate to form a flange-surrounding combined coolant channel GR. Coolant within the block-side coolant jacket $J_B$ flows into the head-side coolant jacket J through the channel GR.

As shown in FIGS. 4 and 9, the head-side flange-surrounding coolant channel 20 is connected to the head-side coolant jacket $J_H$ through a large number of communication holes 22 in a bottom wall of the cylinder head 2. Head-side longitudinal passages 23 having a diameter larger than that of the communication hole 22 are also provided in the bottom wall of the cylinder head 2 to directly connect with the block-side longitudinal passages 18. Coolant within the downstream coolant channel 13, as shown by an arrow in FIG. 5, can flow through the block-side longitudinal passages 18, the holes 21 in the gasket G, and the head-side longitudinal passages 23, directly into the head-side coolant jacket $J_H$ to effectively cool the heated portions between the adjacent cylinders 3.

As shown in FIG. 10, the plurality of block-side dispensing passages 15, the plurality of holes 21 in the gasket G, and the plurality of head-side communication holes 22, are misaligned from each other around the cylinder 3. Therefor, coolant flows uniformly through channel GR, but in a zigzag and diverted manner, as shown by arrows in FIG. 10.

Figure 11:
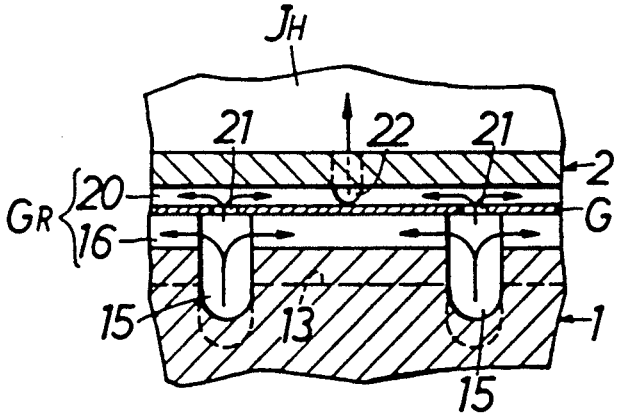
FIG. 11 is a similar section view illustrating a modification of the first embodiment similar to FIG. 10.

A modification of the design shown in FIG. 10 is shown in FIG. 11, wherein circumferential phases of block-side dispensing passages 15 and holes 21 in the gasket G are aligned with each other.

In FIGS. 4, 5 and 9, reference character $V_1$ is an intake valve; $V_E$ is an exhaust valve; Pc is a spark plug; $C_C$ is a combustion chamber; and $B_0$ is a bolt connecting the cylinder block 1 with the cylinder head 2.

The operation of the first embodiment of the present invention shown in FIGS. 1 to 10 will be described below.

Coolant, such as water, is pumped into the main coolant channel 8 by the pump 10 connected to the cooling circuit. When the main coolant channel 8 has been filled, coolant flows through the orifice passages 12, which increase the flow speed. Coolant then flows uniformly within the upstream coolant channel 11 and is supplied into the block-side coolant jacket $J_B$ comprising the plurality of coolant passages 6. Coolant entering the coolant passages 6 of the block-side coolant jacket $J_B$ flows along the cylinder axis $l_1$—$l_1$ and then into the downstream coolant channel 13, while cooling the outside of the heated body of each wet liner 5 in the cylinder block 1.

In this way, the coolant flows from the main channel 8 via the orifice passages 12 and through the upstream coolant channel 11 into the block-side coolant jacket $J_B$. Hence, an increase in flow speed can be uniformly distributed into the block-side coolant jacket $J_B$. Moreover, the block-side coolant jacket $J_B$ has its cooling surface area substantially increased by the presence of the large number of cooling fins 5b. Because of an enlarged flow sectional area of the common coolant passages $6_1$ at the boundary portion between the adjacent wet liners 5, much coolant can be passed through the inter-flange coolant passage at the boundaries of the wet liner flanges. These portions are usually at the highest temperature.

Coolant which has entered the downstream coolant channel 13 flows through the dispensing passages 15 into the block-side flange-surrounding coolant channel 16 as shown in FIG. 10 or 11. Coolant then flows through the communication holes 21 in the gasket G into the head-side flange-surrounding coolant channel 20. During this time, highly heated portions such as the outer periphery of the outward flange portion 5a of the wet liner 5 and the joined surfaces of the cylinder block 1 and the cylinder head 2 can be uniformly and effectively cooled. Then, the coolant in the head-side flange-surrounding coolant jacket 20 flows through the plurality of communication holes 22 into the head-side coolant jacket $J_H$ to cool the cylinder head 2.

A portion of the coolant within the upstream coolant channel 11 flows into the rectilinear inter-flange coolant passage 17 and from there through the relatively large diameter of longitudinal passages 18 and 23 at opposite ends of the passage 17 directly into the head-side coolant jacket $J_H$. This intensively cools the adjoining boundary portions of the outward flanges 5a of the adjacent wet liners 5.

Figure 12:
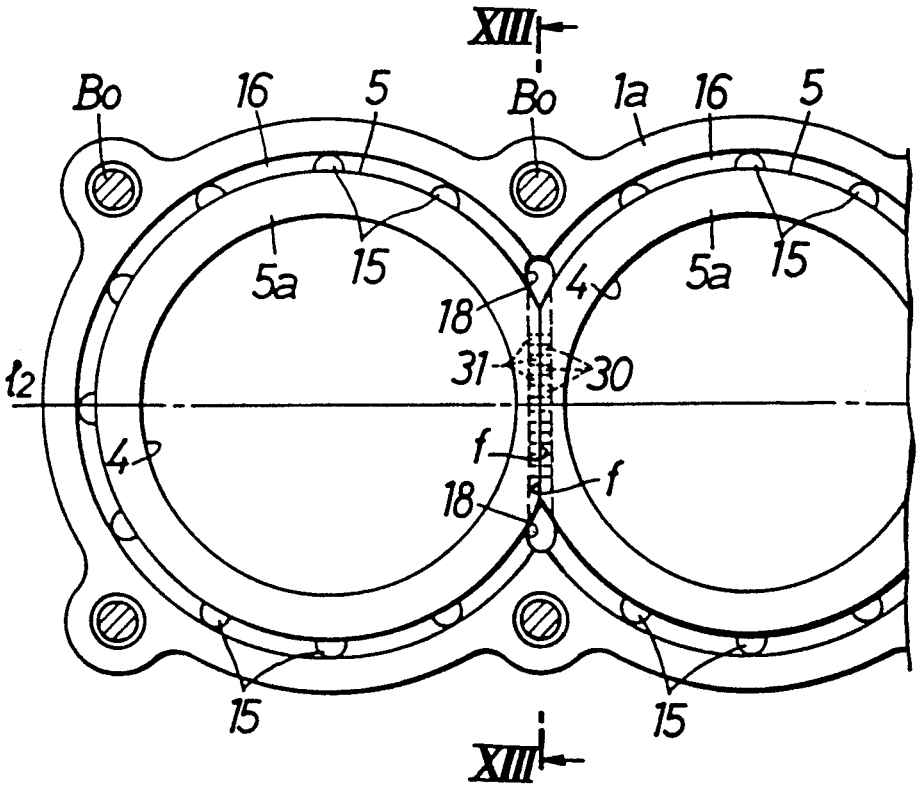
Figure 13:
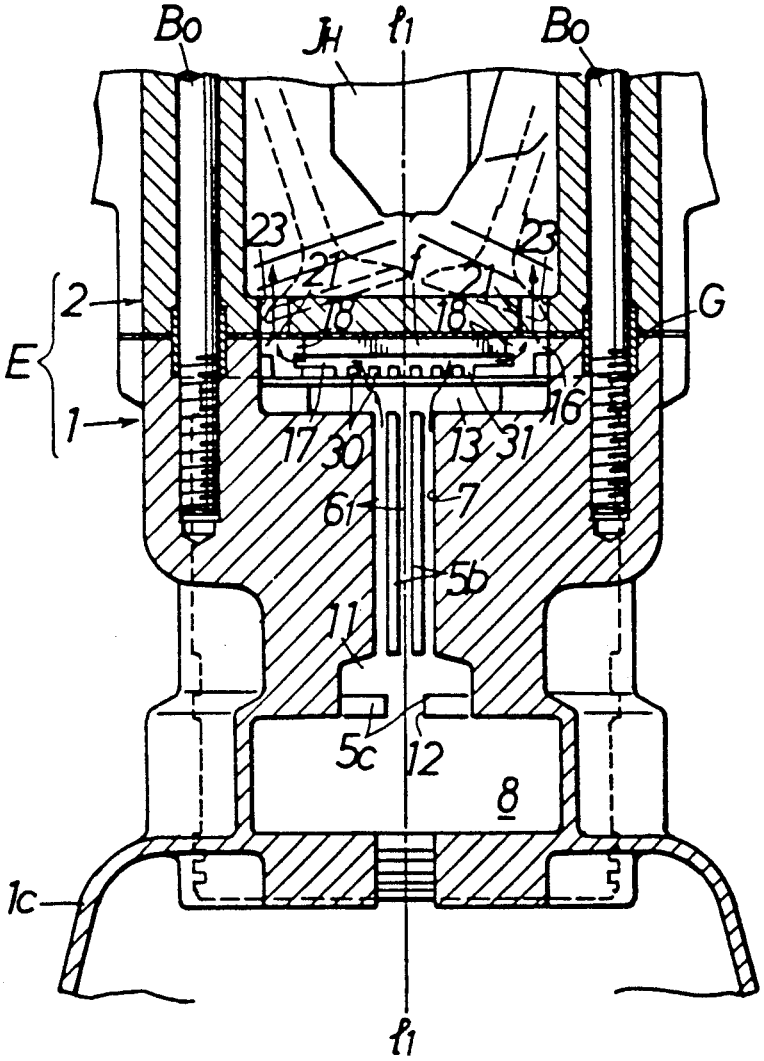
Figure 14:
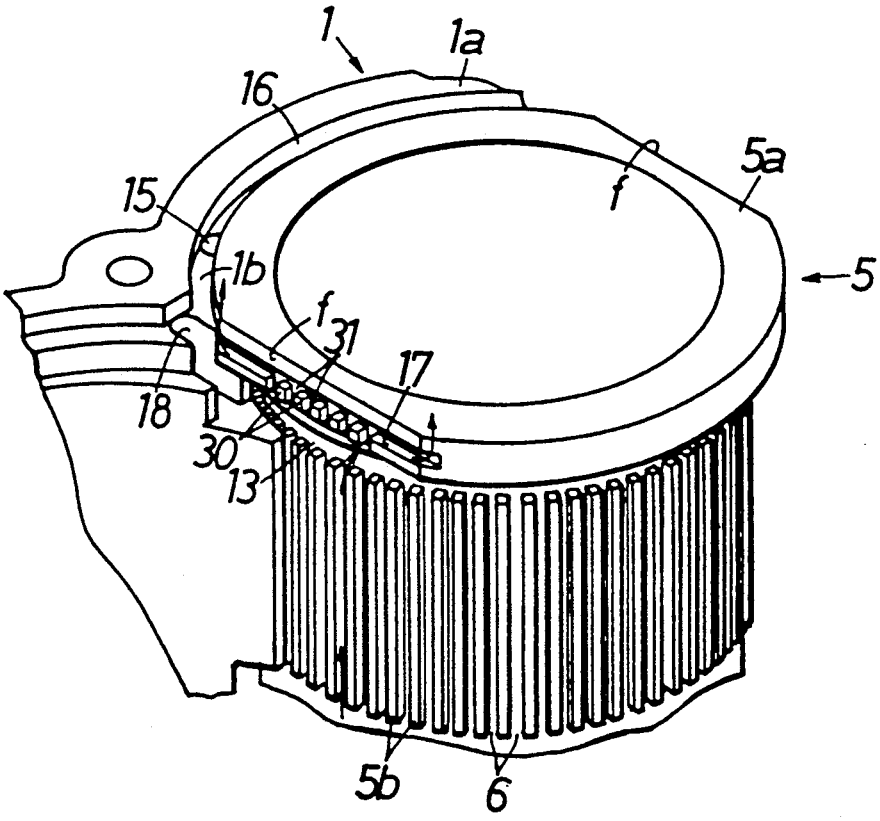

A second embodiment is shown in FIGS. 12 to 14. In the second embodiment, a plurality of cooling fins 30 are provided on a lower half of the chamfered portion f of the outward flange 5a of the wet liner 5 and extend in the direction of the cylinder axis $l_1$—$l_1$. A plurality of short coolant passages 31 are defined between the cooling fins 30. The downstream coolant channel 13 is permitted to communicate with the inter-flange coolant passage 17 through the short passages 31. Thus, coolant within the downstream coolant channel 13, as shown by arrow's in FIG. 13, can be passed through the short passages 31 into the inter-flange coolant passage 17, to efficiently cool the adjoining portions of the outward flanges 5a of the adjacent wet liners 5.

Figure 15:
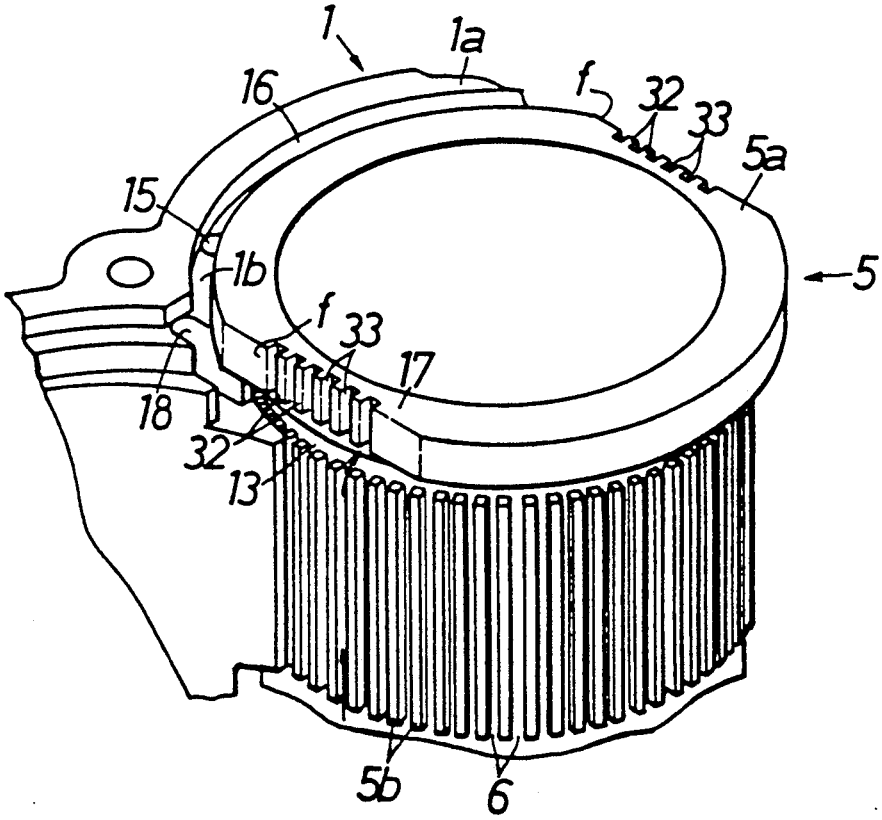
FIG. 15 is a perspective view of a portion of a cylinder block in a third embodiment of the present invention.

In a third embodiment as shown in FIG. 15, a plurality of cooling fins 32 are provided on each of the mutually-contacting flat chamfered portions f of the outward flanges 5a of the adjacent wet liners 5 to extend along the cylinder axis $l_1$—$l_1$. A plurality of coolant passages 33 are defined between the cooling fins 32 and open into the upper and lower surfaces of the outward flange 5a to communicate with the downstream coolant channel 13 and the head-side coolant jacket $J_H$. Thus, the coolant within the downstream coolant channel 13 can be passed through the plurality of coolant passages 33 into the head-side coolant jacket $J_H$ to efficiently cool the adjoining portions of the outward flanges 5a, 5a of the adjacent wet liners 5.

Figure 16:
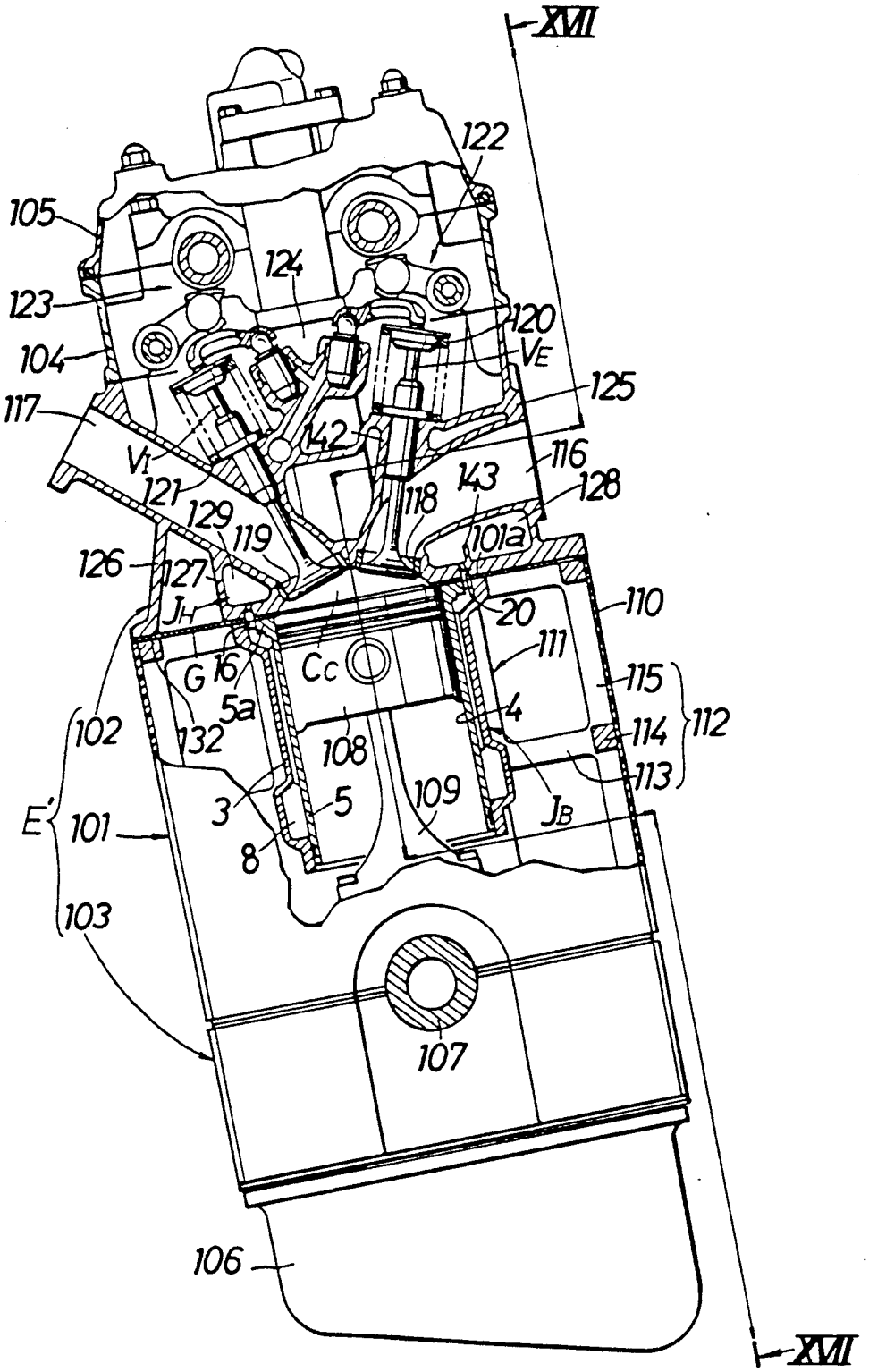
Figure 17:
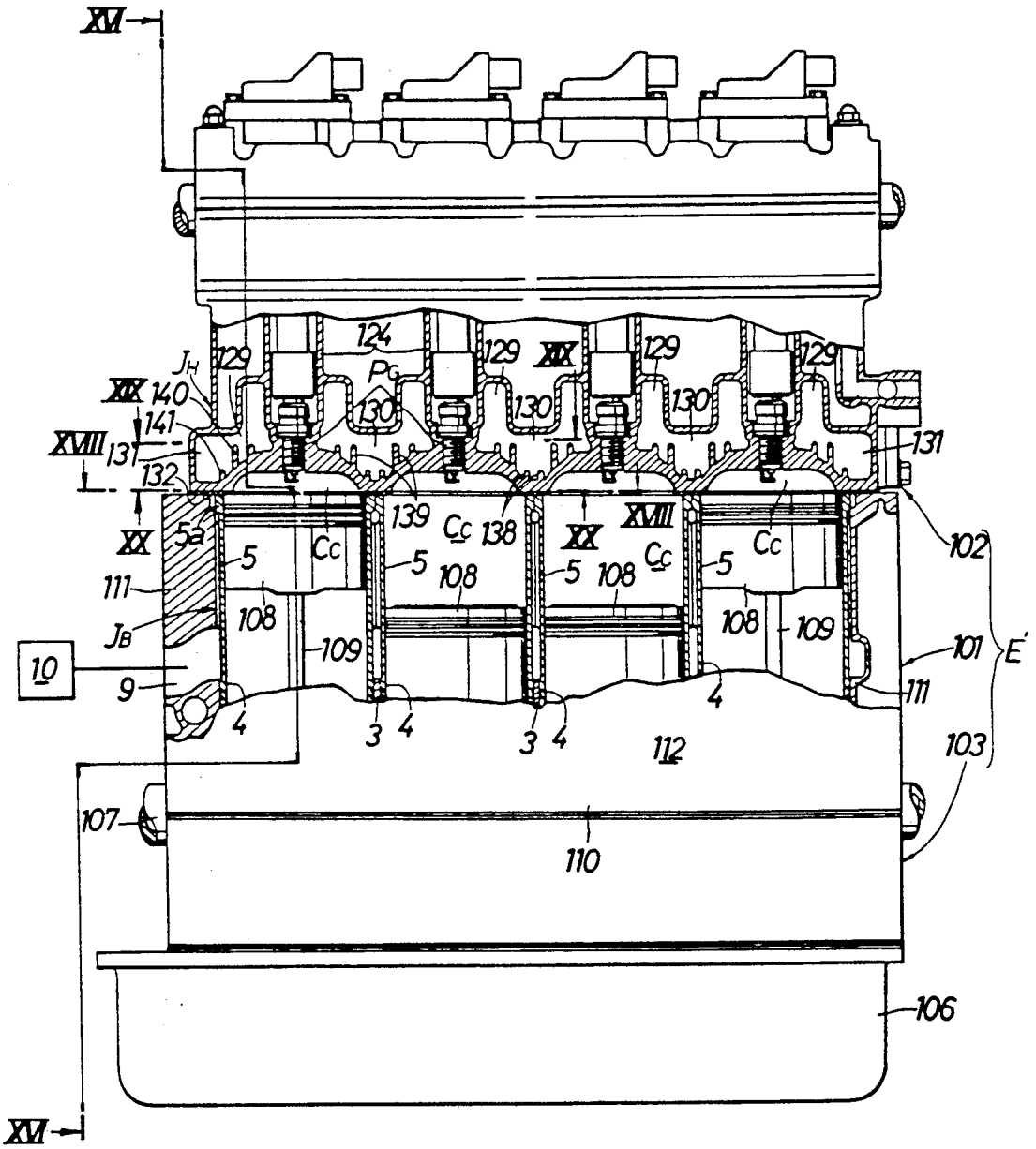
Figure 18:
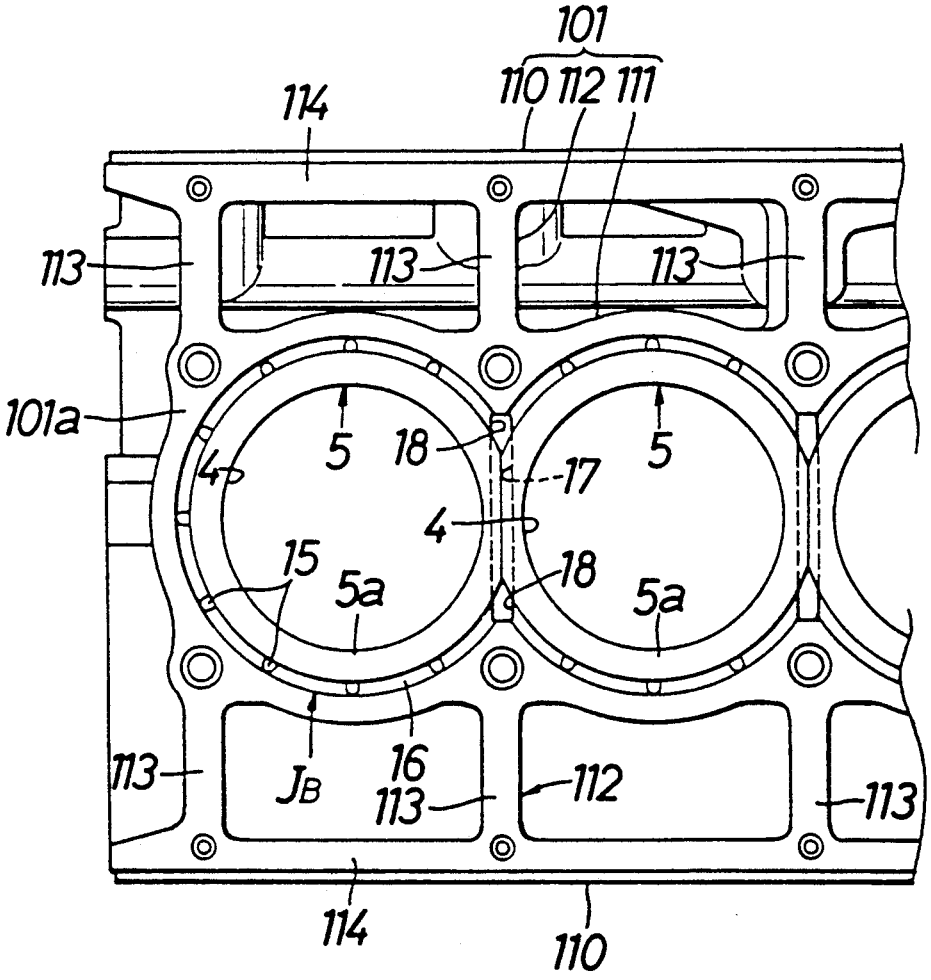
Figure 19:
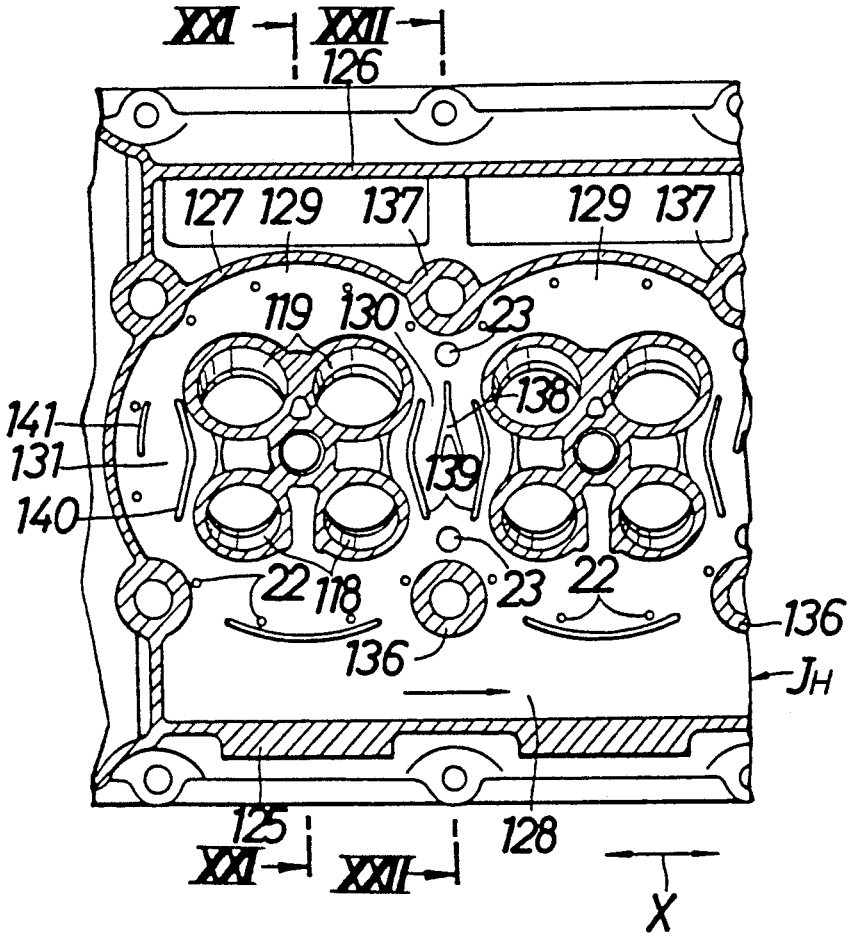
Figure 20:
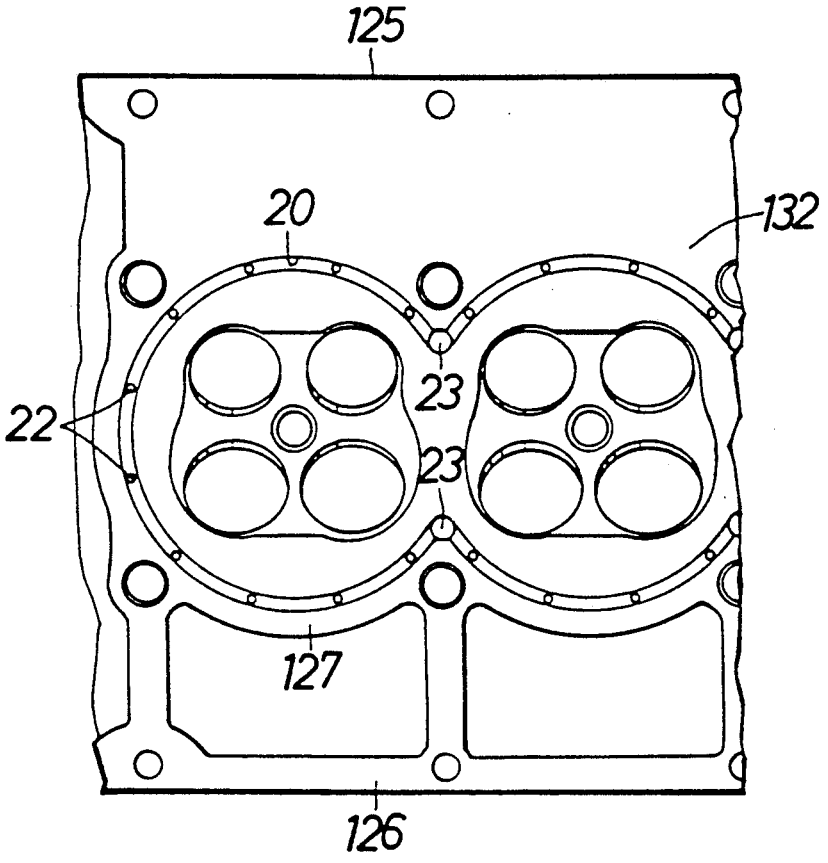
Figure 21:
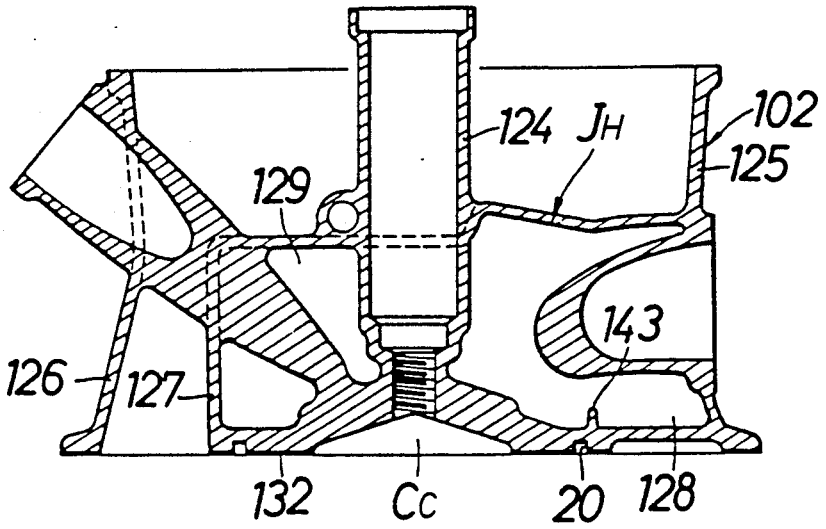
Figure 22:
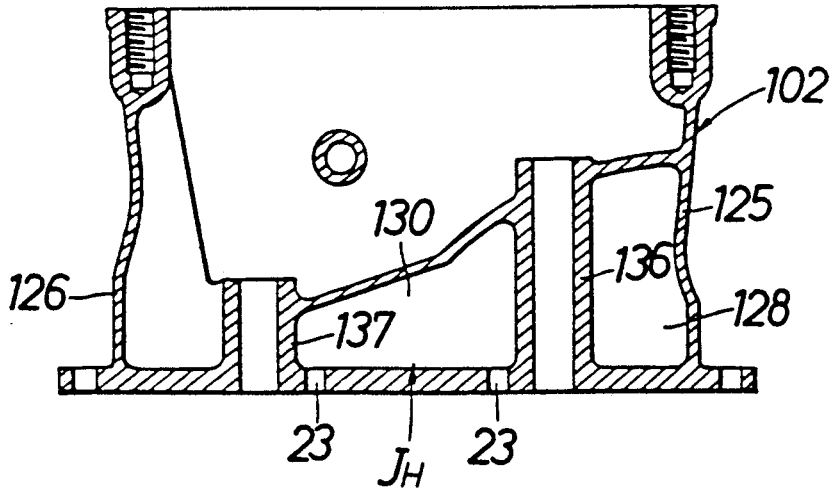

In a fourth embodiment as shown in FIGS. 16 to 18, a body E' of an engine comprises a cylinder block 101 including four cylinder bores 4. A cylinder head 102 is joined to a deck surface 101a of the cylinder block 101 through a gasket G, and a crank case 103 is coupled to a lower surface of the cylinder block 101. A head cover 105 is attached to an upper surface of the cylinder head 102 through a cam case 104. An oil pan 106 is joined to a lower surface of the crank case 103. A crank shaft 107 is rotatably carried between mated surfaces of the cylinder block 101 and the crank case 103. Pistons 108 are slidably received in the cylinder bores 4 and are connected to the crank shaft 107 through respective connecting rods 109.

The cylinder block 101, except for a rigid membrane member 110, is integrally formed from iron or a light alloy material such as aluminum and magnesium alloys by casting. The entire cylinder block 101 is shaped into a quadratic prism. More specifically, the cylinder block 101 is constructed by three parts: a cylinder barrel-combined block 111, a framework 112 and a rigid membrane member 110. This provides a lightweight, high-strength and highly rigid cylinder block.

The cylinder barrel-combined block 111 forms a main strengthening member for the cylinder block 101. It is constructed as a unit which comprises four cylinders 3 arranged in a row with their adjoining boundary portions connecting with one another. A wet liner 5 having an outward flange 5a at its upper end is inserted into each of the cylinders 3, thereby defining cylinder bores 4 each having a vertically extending axis.

The framework 112, which is a strengthening member for the cylinder block 101, is integrally formed into a three-dimensional latticework structure by casting from the same material as the combined block 111 so as to surround an outer periphery of the cylinder barrel-combined block 111. The framework 112 comprises the following components integrally coupled: a plurality of traverse beams 113 projecting from the cylinder barrel-combined block 111 in a lateral direction substantially perpendicular to the crank axis; longitudinal beams 114 having a square cross-section and connected to outer ends of the traverse beams 113; and pillars 115. The longitudinal beams 114 are uniformly spaced apart vertically and extend parallel to one another. The pillars 115 are substantially uniformly spaced apart longitudinally of the cylinder barrel-combined block 111 and extend in parallel to one another and vertically of the combined block 111.

The construction of the framework 112 by framing the traverse beams 113, the longitudinal beams 114 and the pillars 115 into a three dimensional latticework structure ensures that the framework is lightweight and has high bending and torsional strength.

The rigid membrane member 110 comprising either a single metal sheet (such as steel or aluminum sheet), or a single reinforced synthetic resin sheet (such as FRP and FRM) is bonded with an adhesive directly to each of the rectilinear left and right outer side faces of the framework 112. The adhesive used may be, for example, FM-300 (made by American Cyanamid Corp.) including a heat-resistant epoxy-based resin as a main constituent.

The formation of the left and right outer side faces of the framework 112 into a vertically straight surface ensures that the rigid membrane member 110 can be also formed from a sheet material, to facilitate its fabrication as a highly rigid member or a vibration damper. The rigid membrane member 110 can bear bending action on the cylinder block 101, and torsional vibration about the crank shaft 107, mainly as shear stresses, because of its rectilinear form substantially parallel to the axes of the cylinder bores 4.

In the cylinder block 101, as shown in FIGS. 16 and 18, a block-side coolant jacket or the like is defined between each of the wet liners 5 and each of the cylinders 3. A rectilinear inter-flange coolant passage 17, as shown in FIG. 18, is defined between the outward flange portions 5a of the adjacent wet liners 5, as in the first embodiment.

The crank case 103 is formed so that its planar shape may be substantially identical to the planar shape of the cylinder block 101. Accordingly, as shown in FIGS. 16 and 17, the assembly of the cylinder block 101 and crank case 103 is a quadratic prism-like structure, with all front and rear end faces and left and right side faces of the engine body E1 being vertically straight.

The cylinder head 102, coupled to the cylinder block 101, defines combustion chambers $C_C$ above the pistons 108 in the cylinder bores 4. A pair of exhaust valves $V_E$ and a pair of intake valves $V_I$ are openably and closably disposed in the cylinder head 102 for each of the combustion chambers $C_C$. More specifically, to construct a so-called cross-flow type intake and exhaust system, exhaust ports 116 open to one side face of the cylinder head 102 (the right side as viewed in FIG. 16). The intake ports 117 open tot he other side face of the cylinder head 102 (the left side as viewed in FIG. 16). In a roof surface of each combustion chamber $C_C$ are a pair of exhaust openings 118 leading to the exhaust ports 116, and a pair of intake openings 119 leading to the intake ports 117. The exhaust valves $V_E$ are arranged to open and close the exhaust openings 118 and intake valves $V_I$ are arranged to open and close the intake openings 119, respectively.

Each exhaust valve $V_E$ and each intake valve $V_I$ is biased in a closing direction by valve springs 120 and 121. The cam case 104 carries essential parts of an exhaust-side valve operating device for opening and closing the exhaust valves $V_E$ as well as essential parts of an intake-side valve operating device for opening and closing the intake valves $V_I$.

At a central portion of each of the combustion chambers $C_C$, a cylindrical central block 124, integral with the cylinder head 102, extends upwardly to permit a spark plug PG to project into each of the combustion chambers $C_C$.

The cylinder head 102 is coupled to the cylinder block 101, with outer surfaces of outside walls 125 and 126 of the head 102 being substantially aligned with the side faces of the cylinder block 101. The cylinder head 102 is coupled to the cylinder block 101 and its outside walls 125 and 126 are disposed substantially continuously with the rigid membrane members 110. A jacket sidewall 127 in the cylinder head 102, inside the outside wall 126, defines a head-side coolant jacket $J_H$ connecting with the block-side coolant jacket $J_B$. Thus, the head-side coolant jacket $J_H$ is defined between the jacket sidewall 127 and the outside wall 125.

Referring now to FIGS. 19, 20, 21 and 22, the head-side coolant jacket $J_H$ comprises a channel portion 128 extending in the direction X on the outside wall 125 containing the exhaust ports 116. First branch passages 129 disposed above the combustion chambers surround the central block 124. A plurality (three in this embodiment) of second branch passages 130 are disposed between the adjacent combustion chambers $C_C$. Two third branch passages 131 are disposed outside the first branch passages 129. To provide a dominant flow of coolant within the head-side coolant jacket $J_H$ from the left side to the right side as viewed in FIG. 16, and from the top to the bottom as viewed in FIG. 19, the branch passages 129, 130 and 131 are commonly connected to the channel portion 128 and also with the block-side coolant jacket $J_B$.

As in the first embodiment, on the bottom face surface 132 there is a head-side flange-surrounding coolant channel 20 which connects to a block-side flange-surrounding coolant channel 16 (see FIGS. 3, 4 and 16) through holes in the gasket G. Coolant channel 20 has the same shape as channel 16. As in the first embodiment, the cylinder head 102 has communication or connection holes 22 and longitudinal passages 23 connecting the coolant channel 20 and the head-side coolant jacket $J_H$. The communication holes 22 are arranged at uniform distances and connect with the head-side flange-surrounding coolant channel 20 formed along a phantom circle corresponding to the block-side flange-surrounding coolant channel 16 and join with the first and third branch passages 129 and 131. The longitudinal passages 23 connect the head-side flange-surrounding coolant channel 20 with the second branch passages 130 and are disposed each in a pair corresponding to each of the second branch passages 130. Each of the communication holes 22 and each of the longitudinal passages 23 are inclined toward the spark plug $P_G$.

At the cylinder bores 4 outside the head-side flange-surrounding coolant channel 20, the cylinder head 102 has pairs of vertically extending cylindrical bosses 136 and 137. Bolts (not shown) are inserted into bosses 136 and 137 for coupling the cylinder head 102 to the cylinder block 101. The bosses 137 are integral with the jacket sidewall 127. The first and second branch passages 129 and 130 are divided by a fin 138 mounted in a projecting manner on a lower wall or floor surface of the head-side coolant jacket $J_H$ and curved toward the first branch passage 129. The fin 138 is disposed between the bosses 136 and 137 so that its opposite ends are spaced apart from them. Therefore, the first and second branch passages 129 and 130 connect with each other, but the degree of connection between the passages is set so that the direction of the dominant coolant flow in each of the branch passages 129 and 130 is not obstructed. Auxiliary fins 139 are mounted in a projecting manner on the lower wall surface of the head-side coolant jacket $J_H$ in correspondence to the second branch passage 130, in order to insure the direction of the dominant coolant flow in the second branch passage 130.

The first and third branch passages 129 and 131 are also divided by a fin 140 which is mounted in a projecting manner on the lower wall surface of the head-side coolant jacket $J_H$ and curved toward the first branch passage 128. The fin 140 is disposed between the bosses 136 and 137 so that its opposite ends are spaced apart from them. Therefore, the first and third branch passages 129 and 131 connect with each other, but the degree of connection between the passages 129 and 131 may be set so that the direction of the dominant coolant flow in each of the branch passages !29 and 131 is not obstructed. Furthermore, an auxiliary fin 141 is mounted in a projecting manner on the lower wall surface of the head-side coolant jacket $J_H$ to insure the direction of the dominant coolant flow in the third branch passage 131.

In this manner, not only the central block 124, the pair of exhaust openings 118, and the pair of intake openings 119, but also the first branch passage 129 surrounding guide portions 142 for the exhaust valves $V_E$, are defined between the second branch passages 130, 130 on the opposite sides, or between the second and third branch passages 130 and 131. Since the lower wall surface of the head-side coolant jacket $J_H$ is raised upwardly at the combustion chambers $C_C$, the upper wall surface of the head-side coolant jacket $J_H$ is formed so that its first branch passage 129 may be at a level higher than the second and third branch passages 130 and 131, thereby avoiding excessive coolant flow speed in the first branch passage 129.

The closer to the channel 128, the larger the amount of coolant will flow in the second branch passage 130, because the pair of longitudinal passages 23, 23 are disposed at starting and terminating ends of the second branch passage 130 for the coolant flow. At the second branch passage 130, the upper wall surface of the head-side coolant jacket $J_H$ is sloped so that it may be gradually raised toward the channel 128 to accommodate this distribution.

The first branch passage 129 and the channel 128 are divided by a fin 143 which is mounted in a projecting manner on the lower wall surface of the head-side coolant jacket between the bosses 136. The fin 143 is formed in a curved manner toward the channel 128 between the bosses so that its opposite ends are spaced apart from them. Thus, the coolant passing through the first, second and third branch passages 129, 130 and 131 flows between the fin 143 and the bosses 136 into the channel 128.

The operation of the fourth embodiment will be described below. The coolant which has cooled the cylinder block 101 in the block-side coolant jacket $J_B$ enters the head-side coolant jacket $J_H$ to cool the cylinder head 102 and is then discharged. The head-side coolant jacket $J_H$ is formed with its flow area relatively decreased by the jacket side wall 127, even though the cylinder head 102 is made wide to match the cylinder block 101 for high rigidity and strength. Therefore, the speed of the coolant flowing in the head-side coolant jacket $J_H$ can be increased to a relatively high level. Hence, cylinder head 102 can be efficiently cooled.

The head-side coolant jacket $J_H$ is divided into the channel 128, the first branch passage 129, the second branch passages 130 and the third branch passage 131. The coolant entering the individual branch passages 129, 130, 131 then flows with its dominant flow direction toward the channel 128. Therefore, it is possible to design the passages so the coolant flows at different suitable speeds in the branch passage 129, 130, 131 to improve the cooling efficiency and to eliminate hot points between adjacent cylinders.

The portion of the cylinder head 102 which is heated to the highest temperature is a portion corresponding to the combustion chamber $C_C$, i.e., a portion corresponding to the first branch passage 129. The portion of the cylinder block 101 which is heated to the highest temperature is a portion corresponding to a section located between the adjacent cylinder bores. The coolant passed between the adjacent cylinder bores 4 in the block-side coolant jacket $J_B$, flows from the block-side longitudinal passage 18 through the head-side longitudinal passages 23 into the second branch passage 130, and substantially cannot enter the first branch passage 129. Thus, it is possible to guide the coolant having a relatively low temperature into the first branch passage 129, thereby efficiently cooling the highly-heated portion corresponding to the combustion chamber $C_C$.

Figure 23:
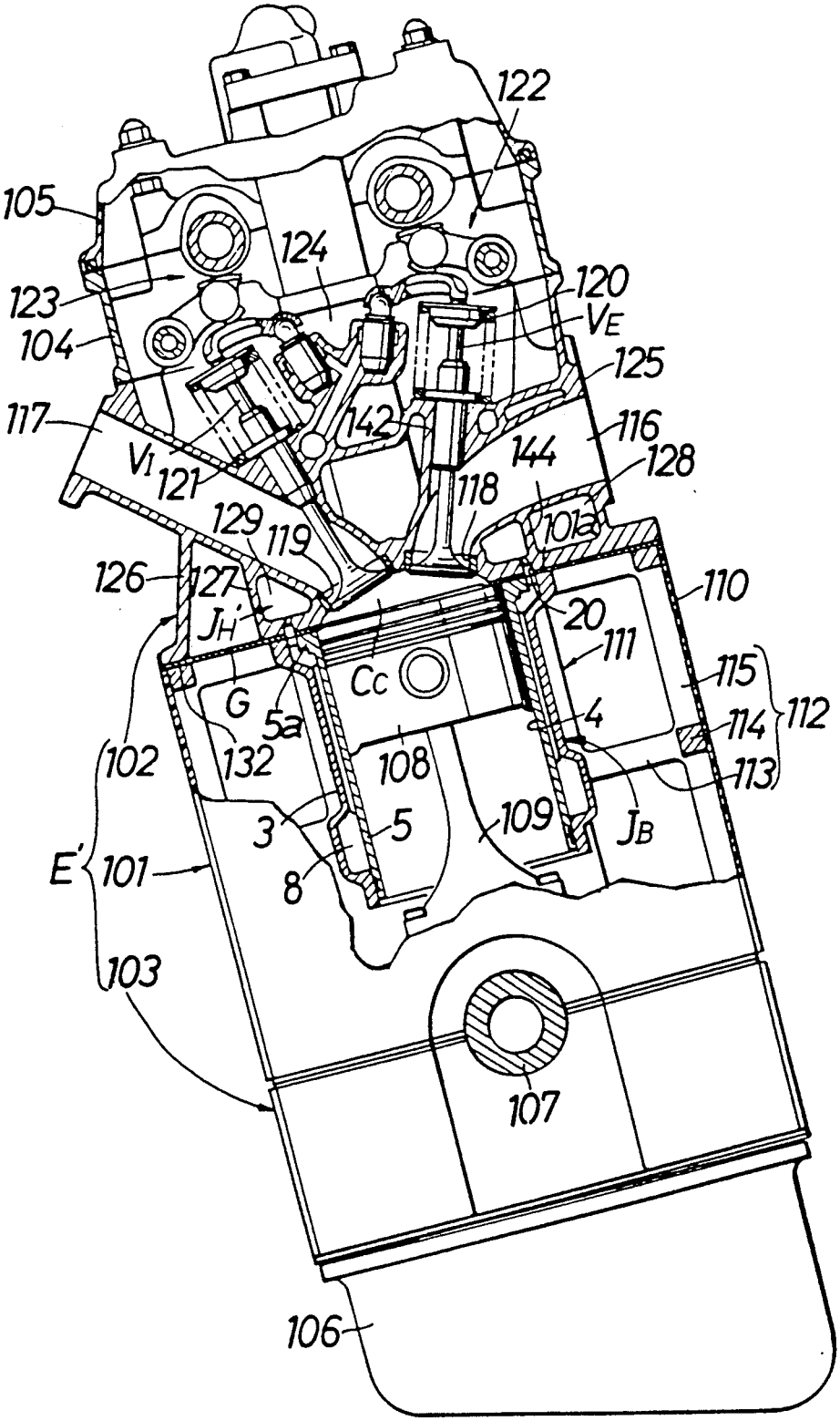
FIG. 23 is a front section view similar to FIG. 16, but illustrating a fifth embodiment of the present invention.

FIG. 23 illustrates a fifth embodiment, wherein a head-side coolant jacket $J_H'$ is defined between jacket sidewalls 127 and 144 which are disposed inside the opposite outside walls 125 and 126 of the cylinder head 102, respectively.

Also in this embodiment, it is possible to increase the flow speed of coolant in the head-side coolant jacket $J_H'$ to a relatively fast level, thereby improving the cooling efficiency.

Although the above embodiments of the present invention have been applied to the four-cylinder engine, it will be understood that the present invention is applicable to other types of multi-cylinder engines, and that various liquids other than water can be used as a coolant.

Accordingly, several embodiments have been shown and described. It will be apparent to those skilled in the art that other modifications may be made without departing from the spirit and scope of the invention.

What is claimed is:

1. A cooling system for a multi-cylinder engine, comprising:

a block-side coolant jacket positioned around a plurality of in-line cylinder bores in a cylinder block;

an endless main channel extending around the cylinder bores upstream of said block-side coolant jacket; and an upstream coolant channel between said block-side coolant jacket and said main coolant channel surrounding the cylinder bores, said upstream coolant channel and said main coolant channel connected through a plurality of orifice passages provided around each of the cylinder bores, and said upstream coolant channel connected with an upstream end of said block-side coolant jacket.

2. A cooling system for a multi-cylinder engine according to claim 1, wherein a plurality of said orifice passages are provided at circumferentially spaced apart distances around the outer periphery of each of the cylinder bores.

3. A cooling system for a multi-cylinder engine, comprising:

a block-side coolant jacket positioned around a plurality of in-line cylinder bores in a cylinder block, said block-side coolant jacket including a a coolant passage independently defined around each of the cylinder bores;

a main coolant channel provided around the cylinder bores upstream of said block-side coolant; and an upstream coolant channel provided between said block-side coolant jacket and said main coolant channel to separately surround each of the cylinder bores, said upstream coolant channel and said main coolant channel connected to each other through an orifice passage around each of the cylinder bores, and said upstream coolant channel also connected to an upstream end of said block-side coolant jacket.

4. A cooling system for a multi-cylinder engine according to claim 3, further including a downstream coolant channel around each of the cylinder bores downstream of said block-side coolant jacket, said coolant channel connected to a downstream end of said block-side coolant jacket.

5. A cooling system for a multi-cylinder engine according to claim 4, wherein the cylinder bores have upper ends and lower ends and said main coolant channel, said upstream coolant channel, said block-side coolant jacket and said downstream coolant channel are respectively arranged in order from the lower end to the upper end of the cylinder bores.

6. A cooling system for a multi-cylinder engine according to claim 1, 2, 3, 4 or 5, wherein said cylinder bore has a wet liner fitted therein, and said block-side coolant jacket is formed between said wet liner and a cylinder wall of said cylinder block.

7. A cooling system for a multi-cylinder engine comprising:

a plurality of in-line cylinders provided in a cylinder block;

cylinder liners inserted in the cylinders, each cylinder liner having an upper end with an outward flange;

a block-side coolant jacket provided in the cylinder block surrounding each of said cylinder liners;

a block-side flange-surrounding coolant channel provided in the cylinder block and substantially surrounding the outward flange of each cylinder liner;

a plurality of dispensing passages connecting said block-side coolant jacket and said flange-surrounding coolant channel; and a plurality of vertically extending coolant passages formed between a plurality of vertically extending fins attached around the outside of each cylinder liner;

wherein adjacent cylinder liners have adjoining portions of the outward flanges which are chamfered flatly and in contact with each other, with a rectilinear inter-flange coolant passage defined between the contacting flanges and said coolant passage being in communication with said block-side coolant jacket.

8. A cooling system for a multi-cylinder engine according to claim 7, wherein opposite open ends of said inter-flange coolant passage are in communication with said block-side flange-surrounding coolant channel, so that coolant from said block-side coolant jacket is passed through said inter-flange coolant passage to said block-side flange-surrounding coolant channel.

9. A cooling system for a multi-cylinder engine according to claim 8, wherein said block-side coolant jacket and said block-side flange-surrounding coolant channel are in direct communication with each other through longitudinal passages provided at opposite ends of said inter-flange coolant passage.

10. A cooling system for a multi-cylinder engine according to claim 8, wherein the engine has a crankshaft and said rectilinear inter-flange coolant passage extends in a direction substantially perpendicular to the crankshaft to communicate with said block-side flange-surrounding coolant gallery.

11. A cooling system for a multi-cylinder engine according to claim 8, further including a plurality of short passages formed on the chamfered outward flanges and extending along the, the longitudinal axes of the cylinders said block-side coolant jacket and said flange-surrounding coolant channel being in communication with each other through said short passages.

12. A cooling system for a multi-cylinder engine according to claim 7, wherein the cylinder head has a combustion chamber and a head-side coolant jacket is provided in said cylinder head to surround the combustion chamber, said head-side coolant jacket connecting to said block-side flange-surrounding coolant channel through a plurality of communication passages.

13. A cooling system for a multi-cylinder engine according to claim 12, wherein a head-like flange-surrounding coolant chamber overlies and connects with said block-side flange-surrounding coolant channel to provide a flange-surrounding combined coolant gallery.

14. A cooling system for a multi-cylinder engine according to claim 13, wherein said block-side flange-surrounding coolant chamber and said head-side flange-surrounding coolant chamber are in communication with each other through a plurality of holes in a gasket interposed between the cylinder block and the cylinder head.

15. A cooling system for a multi-cylinder engine according to claim 14, wherein said holes in the gasket and said communication passages are provided around each cylinder in a misaligned relation to each other.

16. A cooling system for a multi-cylinder engine according to claim 14, wherein said block-side coolant jacket and said head-side coolant jacket are in direct communication with each other through the holes in the gasket at portions adjacent to the flanges of said adjacent cylinder liners.

17. A cooling system for a multi-cylinder engine comprising:

a plurality of in-line cylinders provided in a cylinder block;

cylinder liners inserted in the cylinders, each cylinder liner having an upper end with an outward flange;

a block-side coolant jacket provided in the cylinder block surrounding each of said cylinder liners;

a block-side flange-surrounding coolant channel provided in the cylinder block and substantially surrounding the outward flange of each cylinder liner;

a plurality of dispensing passages connecting said block-side coolant jacket and said flange-surrounding coolant channel; and a plurality of vertically extending coolant passages formed between a plurality of vertically extending fins attached around the outside of each cylinder liner;

wherein adjoining portions of the outward flanges of said adjacent cylinder liners are chamfered flatly and placed in contact with each other, with a rectilinear inter-flange coolant passage defined between the flanges, said inter-flange coolant passage being in communication with said block-side coolant jacket.

18. A cooling system for a multi-cylinder engine according to claim 7, 8, 9, 10, 11, 12, 13, 14, 15 or 16, wherein said cylinder liner is a wet liner and the block-side coolant jacket is formed around the wet liner.

19. A cooling system for a multi-cylinder engine comprising:

an engine block including a cylinder block having a block-side coolant jacket surrounding cylinder bores, each cylinder bore having a piston received therein;

a cylinder head having a head-side coolant jacket surrounding combustion chambers defined above said pistons, the head-side coolant jacket communicating with the block-side coolant jacket, with outside walls of said cylinder head on opposite sides of a crank shaft being substantially aligned with opposite outside walls of said cylinder block, said cylinder head having a jacket sidewall disposed inside at least one of the opposite outside walls for defining the head-side coolant jacket;

an exhaust port in one of the opposite outside walls of said cylinder head;

a intake port in the other outside wall, said jacket sidewall disposed inside said outside wall having said intake port provided therein, said head-side coolant jacket defined between said jacket sidewall and said outside wall having said exhaust port provided therein.

20. A cooling system for a multi-cylinder engine according to claim 19, wherein said outside walls of said cylinder block are spaced outwardly from a wall defining the block-side coolant jacket.

21. A cooling system for a multi-cylinder engine according to claim 19, wherein said cylinder block includes a plurality of cylinder bores provided side-by-side therein, and said head-side coolant jacket comprises a plurality of passages separated by fins projecting from a lower wall surface of the cylinder head, to provide a flow of coolant to cool the combustion chambers, and a channel portion provided in the outside wall having the exhaust port provided therein, the channel portion extending alongside the combustion chambers and connecting with the plurality of passages.

* * * * *

UNITED STATES PATENT AND TRADEMARK OFFICE

CERTIFICATE OF CORRECTION

PATENT NO. : 5,086,733

DATED : February 11, 1992

INVENTOR(S) : INOUE et al.

It is certified that error appears in the above-identified patent and that said Letters Patent is hereby corrected as shown below:

Column 4, line 41, delete "61" and insert -- $6_1$ --.

Column 5, line 12, delete "block side" and insert -- block-side --.

Column 6, line 3, delete "J" and insert -- $J_H$ --.

Column 6, line 31, delete "$P_c$" and insert -- $P_g$ --.

Column 9, line 6, delete "tot he" and insert -- to the --.

Claim 3, column 12, line 32, after "coolant" insert -- jacket --.

Signed and Sealed this

Ninth Day of November, 1993

*Attest:*

Bruce Lehman

BRUCE LEHMAN

*Attesting Officer*

*Commissioner of Patents and Trademarks*